US006612617B2

(12) United States Patent
Xu

(10) Patent No.: US 6,612,617 B2
(45) Date of Patent: Sep. 2, 2003

(54) TELESCOPIC DUST-COLLECTING PIPE FOR VACUUM CLEANER

(76) Inventor: Weier Xu, 108-3 Jinshan Road, New District, Suzhou 215011 Jiangsu Province (CN)

( * ) Notice: Subject to any disclaimer, the term of this patent is extended or adjusted under 35 U.S.C. 154(b) by 0 days.

(21) Appl. No.: 09/727,872

(22) Filed: Dec. 1, 2000

(65) Prior Publication Data

US 2002/0038951 A1 Apr. 4, 2002

(30) Foreign Application Priority Data

Sep. 30, 2000 (CN) ..... 00254173

(51) Int. Cl.[7] ..... A47L 9/24

(52) U.S. Cl. ..... 285/7; 285/86; 285/302; 285/303

(58) Field of Search ..... 285/7, 86, 302, 285/303

(56) References Cited

U.S. PATENT DOCUMENTS 2,660,457 A * 11/1953 Mallon
2,963,930 A * 12/1960 Clothier et al.
3,244,437 A * 4/1966 Belicka et al.
3,245,698 A * 4/1966 Fromknecht
3,351,363 A * 11/1967 Downey et al.
4,046,279 A * 9/1977 Rusler
4,079,965 A * 3/1978 Moughty et al. ..... 285/7
4,875,714 A * 10/1989 Lee ..... 285/86
5,332,266 A * 7/1994 Canale ..... 285/7
5,692,782 A * 12/1997 Fischer ..... 285/7
5,941,575 A 8/1999 Herbst ..... 285/7
6,354,635 B1 * 3/2002 Dyson et al. ..... 285/7
6,398,136 B1 * 6/2002 Smith ..... 285/86

FOREIGN PATENT DOCUMENTS

EP 0293 518 12/1987 ..... 88/49
EP 0858 762 2/1997 ..... A47L/9/24

* cited by examiner

*Primary Examiner*—Lynne H. Browne
*Assistant Examiner*—James M. Hewitt
(74) *Attorney, Agent, or Firm*—Needle & Rosenberg, P.C.

(57) ABSTRACT

A telescopic dust collecting pipe for a vacuum cleaner having an outer pipe and an inner pipe slidingly arranged therein and connected to the outer pipe by a locking device. The locking device includes an oriented locking mechanism and a locking element. The locking device fits within oriented grooves in the oriented locking mechanism to lock the inner and outer pipes relative to one another.

15 Claims, 9 Drawing Sheets

B-B

TELESCOPIC DUST-COLLECTING PIPE FOR VACUUM CLEANER

RELATED FIELD

The present invention relates to a vacuum cleaner, specifically to a telescopic dust-collecting pipe for vacuum cleaner.

TECHNICAL BACKGROUND

The known technology, such as EP0293518, has disclosed a dust collecting pipe of vacuum cleaner, including inner pipe, outer pipe and locking device. While pushing the button of said locking device in one direction, locking device could be released, and the inner and the outer pipe could be relatively extended or contracted. However, the button could be pushed only in one direction to release the locking device, while extending and contracting dust-collecting pipe, the directions of the force applied on the dust-collecting pipe are two opposite directions. Therefore, the directions of force applied on the button and on the dust-collecting pipe with same hand are just opposite and it is inconvenient for operating.

To overcome disadvantages of above known technology, the present inventor has proposed a Chinese patent application 00216141.9 titled "Telescopic Dust-Collecting Pipe for Vacuum Cleaner". Its locking device includes a hollow outer layer oriented rack provided on the outer surface of the inner pipe axially and a controlling rod slid relatively to the inner cavity of the hollow outer layer oriented rack as locking oriented mechanism. And on the hollow outer layer oriented rack and the top face of the controlling rod are provided with oriented concave grooves correspondingly. Controlling rod can connect with operating device. Locking block provided in the locking device is pressed against one side of the inner pipe by an elastic element. The working principle of the patent is that in the locking condition, under the pressing of the elastic element the locking block enters into the oriented concave grooves coincided each other of hollow outer layer oriented rack and controlling rod. When extending or contracting telescopic pipe is required, pushing or pulling operating device, controlling rod can produce two directions axial movement relatively to the hollow outer layer oriented rack, and then produces displacement relatively to the hollow outer layer oriented rack. In the meantime locking block is pushed out of the oriented groove and is in releasing condition. As such, the user of the vacuum cleaner can complete the operation of extending or contracting of the extendible and contractible pipe by using push action or pull action of only one hand. The disadvantage of inconvenient operation can be solved substantially.

However, in extending and contracting of this kind of dust collecting pipe and the oriented mechanism of its locking device, outer layer oriented groove on hollow outer layer oriented rack made of metal material has an upward opening end. And the upward opening end is on the surface of telescopic pipe. Therefore, surface processing has to be done for it. Electroplating is normal method. Since it is more difficult to process the side wall of the opening end during surface processing such as electroplating and so on. Therefore, not only increases production cost but also it is difficult to insure its production quality. On the other hand, the opening end of the outer layer oriented groove is on the surface of the telescopic pipe. During long time using, at the opening end dust is easy to enter and difficult to clean. After dust is entering, relative movement between hollow outer layer oriented rack at outside and controlling rod at inside will be not smooth so as to affect its freedom of extending and contracting. In addition, in order to reduce the production difficulty of integral forming of locking device, the hollow outer layer oriented rack provided axially along outer wall of the inner pipe and the inner pipe are separate elements. And planar connecting structure between rack and wall of inner pipe are adopted usually. In general, hollow outer layer oriented rack is welded on the outer wall of the inner pipe by using spot weld. So it is not avoidable that welding spot will appear on the surface of the hollow outer layer oriented rack and the integral appearance of telescopic pipe will be distorted. In addition, the stability of this planar connecting structure is not good enough and easy to break off welded.

BRIEF DESCRIPTION OF THE INVENTION

To overcome disadvantages of above known technology, the object of the invention is to provide a telescopic dust collecting pipe for vacuum cleaner so as to improve the process technology of locking device on the basis of convenient operating by improving connecting structure in the locking device. And causing it simple structure, easy to produce, and insuring stability of the connecting structure of its components. And revealing opening end of the oriented groove is avoidable so as to cause the body of the telescopic pipe not only has tidy appearance, difficult to accumulate dust, but also insuring its quality for using.

The object of the invention is achieved such that a telescopic dust collecting pipe for vacuum cleaner including outer pipe, inner pipe provided slidingly in outer pipe. The outer pipe is connected with the inner pipe by locking device. The locking device comprises of locking oriented mechanism and locking element. Its characteristic is in that, oriented mechanism includes fixed element fixed relatively to the inner pipe and moving element producing axial movement relatively to the fixed element. Oriented groove is arranged axially at least on the same side faces of the fixed element and moving element to form inner, outer double layer oriented groove structures. Moving element connects with operating device and moves axially due to the driving of the operating device, to coincide or stagger inner layer oriented groove with outer layer oriented groove. Said locking element is pressed from side against the direction of the oriented groove by a elastic element. While inner layer oriented groove coincides with outer layer oriented groove locking element can enter into the oriented grooves coincided and locking inner pipe and outer pipe relatively. While inner layer oriented groove staggers with outer layer oriented groove due to axial movement of moving element, locking element is pushed out by groove wall of the inner layer oriented groove and locking condition between inner pipe and outer pipe is released.

Oriented groove arranged axially could be arranged along two side faces of fixed and moving elements. Locking element is pressed against the above oriented groove from two side faces showing pincer-like by elastic element.

Fixed element could be hollow and outer layer oriented groove could be provided on it. Said moving element is provided slidingly in the hollow of the fixed element and inner layer oriented groove is provided on it. The inner layer oriented groove slopes inward from two side faces axially.

Moving element could be also hollow and outer layer oriented groove is provided on it. Said fixed element is provided in the hollow of the moving element and inner layer oriented groove is provided on it. The inner layer oriented groove slopes inward from two side walls axially. One end of the moving element is connected with operating device firmly. The operating device sheaths slidingly on the outside of inner pipe. At least one end of moving element provides with an elastic axial recovering element.

Fixed element could be in hollow shape and it may be hollow outer layer oriented rack. The hollow outer layer oriented rack is provided protrudingly on the outer wall of the inner pipe. Said moving element is arranged in the hollow outer layer oriented rack. An axial opening is provided along top end of hollow outer layer oriented rack. Moving element formed by a controlling rod is provided slidingly in the outer layer oriented rack. The top end of the controlling rod is provided with a flange covering axial opening of top end of hollow outer layer oriented rack. The lower end of hollow outer layer oriented rack could be inlaid in the outer wall of inner pipe.

It is priority that locking element could be locking block or roller. The locking elements could be arranged on two side faces which are corresponding to the oriented grooves and be pressed against one side of the oriented groove by elastic element respectively.

Elastic axial recovering element could be provided on one end of moving element. One end of the elastic element is fixed on one end of inner pipe and the other end is fixed on moving element.

Elastic axial recovering element could be also provided on two axial ends of moving element.

Two ends of moving element could be provided with axial limiting device to limit maximum stroke of moving element.

Locking element is inlaid in controlling pedestal and the controlling pedestal could be provided slidingly along outer wall of the inner pipe.

The basic structure of the invention adopts a fixed element and a moving element as locking oriented mechanism. And on the fixed and moving elements the oriented grooves corresponded each other and arranged axially form inner and outer double layer oriented groove structures to control axial movement of moving element so as to coincide or stagger inner layer oriented groove with outer layer oriented groove. While locking block enters into inner, outer layer oriented grooves coincided, the telescopic pipe is locked. While inner, outer layer oriented grooves are staggered, locking block will be pushed out of the oriented grooves, the telescopic pipe is released. Such that the pushing or pulling operation of controlling rod could achieve extending or contracting of telescopic pipe so as to cause the invention has the characteristic of convenient operating. While the most important characteristic of the invention is that the opening end of oriented groove in the locking device is provided on the side faces of the moving element and fixed element fitted with it. Locking block is pressed into the oriented grooves from side face by an elastic element. So that the upper surface of fixed element may not have opening end again and causing the outer surface of telescopic pipe has tidy appearance as well as prevent opening end from entering dust. Likewise, may also cause processing accuracy of its outer surface reducing greatly and simple processing method could be adopted. Therefore, its producing cost will be reduced greatly.

In the preferable embodiment of the invention, opening grooves of the locking oriented mechanism are arranged symmetrically on two side surfaces of both fixed and moving elements and showing pincer-like locking condition. The stability of the structure is better as well as the condition subjected force of pushing or pulling and can cause extending and contracting operation of telescopic pipe more smoothly. In addition, the fixed element in oriented mechanism may be designed in open style. Manufacturing is simpler and easier to assemble.

METHOD OF EMBODYING THE INVENTION

EMBODIMENT 1

Figure 1:
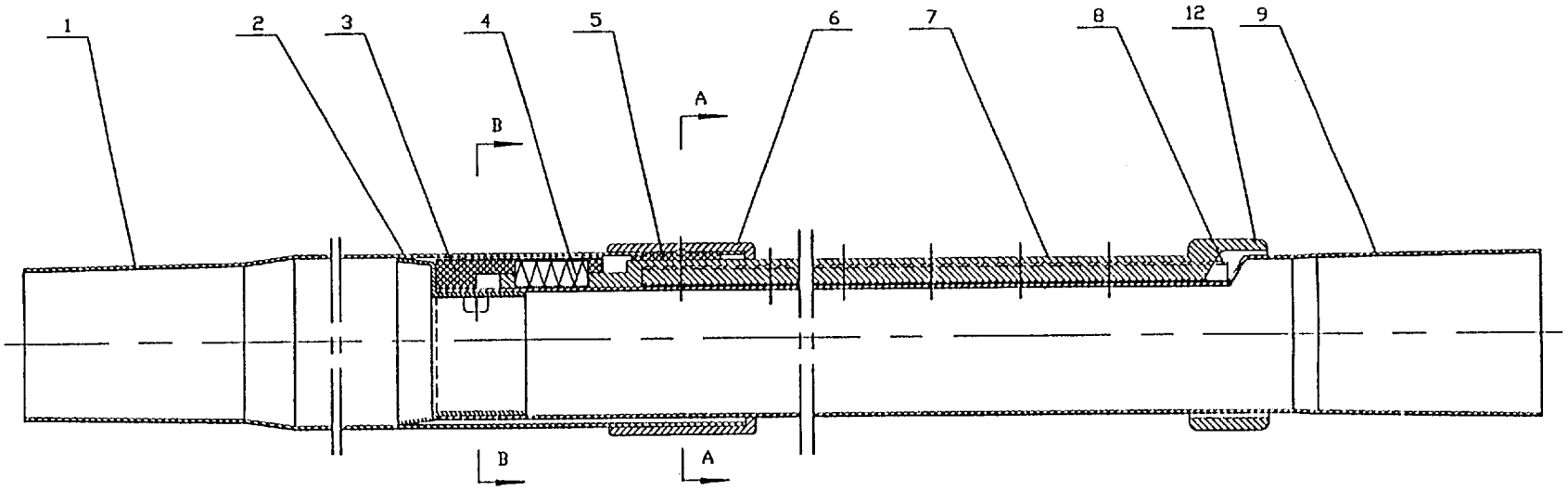
FIG. 1 is a structural sketch of the first embodiment of the invention.
Figure 2:
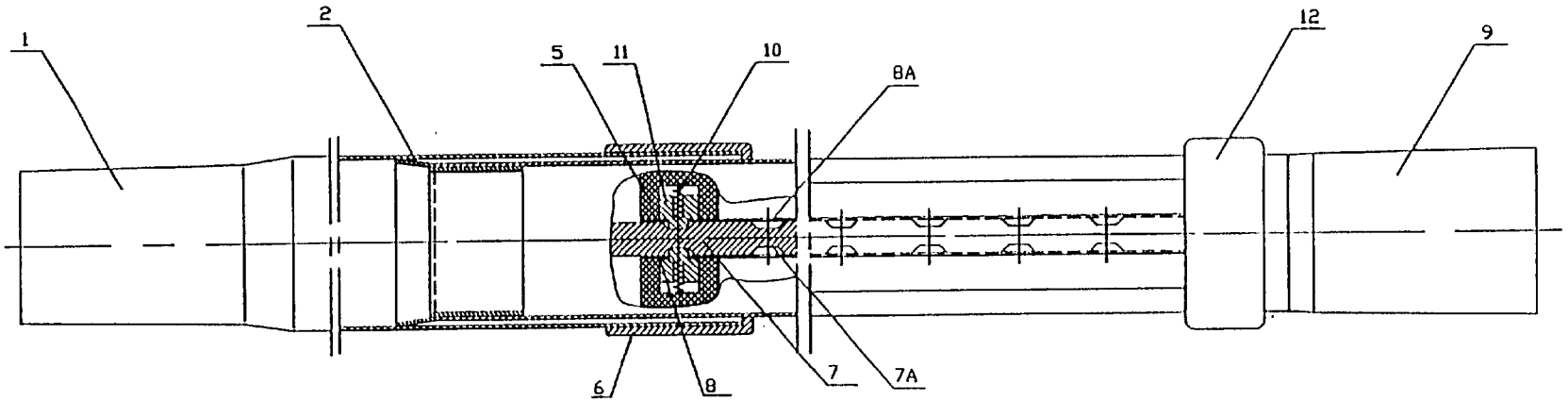
FIG. 2 is vertical view of FIG. 1.

The embodiment is preferable embodiment of the invention, its structure is shown in FIGS. 1 to 5. The invention includes outer pipe 1 and inner pipe 9 arranged slidingly in the outer pipe 1, and locking device using to lock relative position of outer pipe 1 and inner pipe 9. The locking device comprises of locking oriented mechanism and locking element. Said locking oriented mechanism includes a fixed element and a moving element. In the embodiment, the oriented rack 8 fixed relatively to inner pipe 9 forms said fixed element, while the controlling rod 7 produced axial movement relative to the oriented rack 8 forms said moving element. The oriented rack 8 is inlaid axially in the outer surface of inner pipe 9, fixed relatively to the inner pipe 9, and arranged protrudingly on the outer surface of the inner pipe 9. In the embodiment, on oriented rack 8 an opening is arranged axially so as to cause oriented rack 8 forms a hollow open style structure. This kind of structure reduces greatly the difficulty of producing as well as easy to fit and assemble with controlling rod 7.

The main characteristic of the invention is in that, at least on one side face of both fixed and moving elements in the locking oriented mechanism, oriented grooves are arranged axially at intervals correspondingly to form the structure of inner and outer layer oriented grooves. In the embodiment, on two side faces of oriented rack 8 as fixed element outer layer oriented open grooves 8A arranged axially at intervals are all provided symmetrically; controlling rod 7 is arranged through the hollow oriented rack 8, on the controlling rod 7 oriented groove 7A is arranged correspondingly to the oriented rack 8, on the oriented groove 7A side walls are arranged sloped axially. An operating device 12 is connected with the back end of the controlling rod 7, the operating device 12 is sheathed on the inner pipe 9 and could slide along inner pipe 9, either pushing or pulling the operating device 12 can bring controlling rod 7 to do axial movement. After controlling rod 7 moves axially a certain distance, inner layer oriented groove 7A arranged on the controlling rod 7 could be coincided or staggered with outer layer oriented groove 8A of the outer oriented rack 8. Since in the invention, oriented grooves are opened on the side faces of the fixed and moving elements, the drawback to opening oriented groove on the top surface of telescopic pipe so as to distort the integral appearance is avoided.

Locking element in the invention is pressed against one side of oriented groove from side edge relative to the above oriented groove. When inner layer oriented groove 7A coincides with outer layer oriented groove 8A, the locking element is pressed into oriented grooves coincided by elastic element 10 so as to lock inner pipe 9 relative to outer pipe 1. After controlling rod 7 moves axially, inner layer oriented groove 7A is staggered with outer layer oriented groove 8A relatively. The locking element is pushed out by groove wall of inner layer oriented groove 7A so as to release the locking condition of inner pipe relative to outer pipe. In this time, telescopic pipe could be adjusted to the requiring length.

In the embodiment, the front end of controlling rod 7 provides with a elastic element 4, one end of the elastic element 4 is fixed on one end of the inner pipe 9, while the other end is fixed to one end of the controlling rod 7. When the controlling rod 7 is moving, the elastic element 4 is in pressed or tensed condition. When telescopic pipe is adjusted to suitable length, after releasing the operating device 12 elastic element 4 can cause controlling rod 7 to bring inner layer oriented groove 7A recovering. Inner layer oriented groove coincides with outer layer oriented groove, locking element is pressed into the oriented grooves coincided by the elastic element 10, thereby inner pipe 9 is locked relatively to the outer pipe 1. At this time, cleaning operation could be done by the user conveniently and reliably, and do not worry about the sliding of the telescopic pipe thereby affects the operation.

Figure 3:
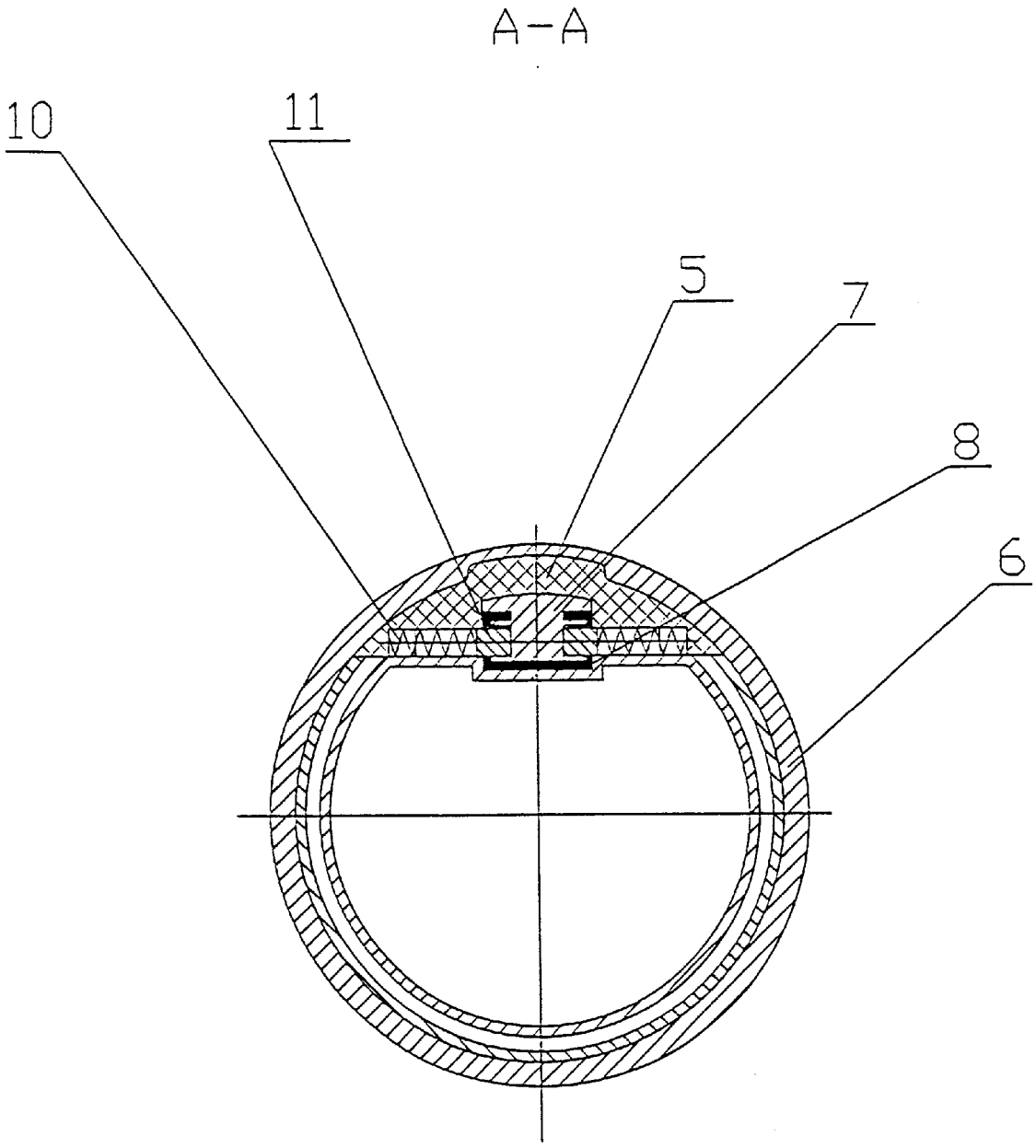
FIG. 3 is A—A sectional view of FIG. 1.
Figure 4:
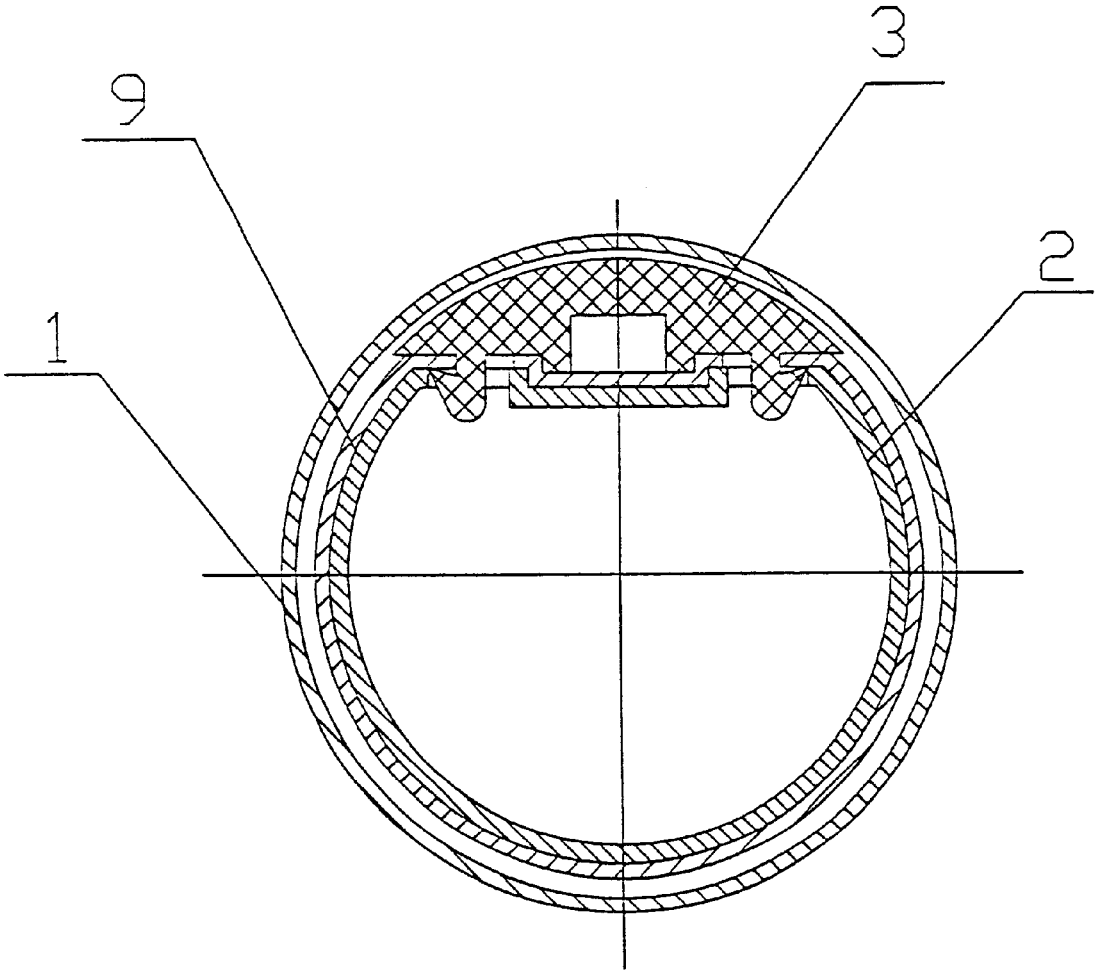
FIG. 4 is B—B sectional view of FIG. 1.
Figure 5:
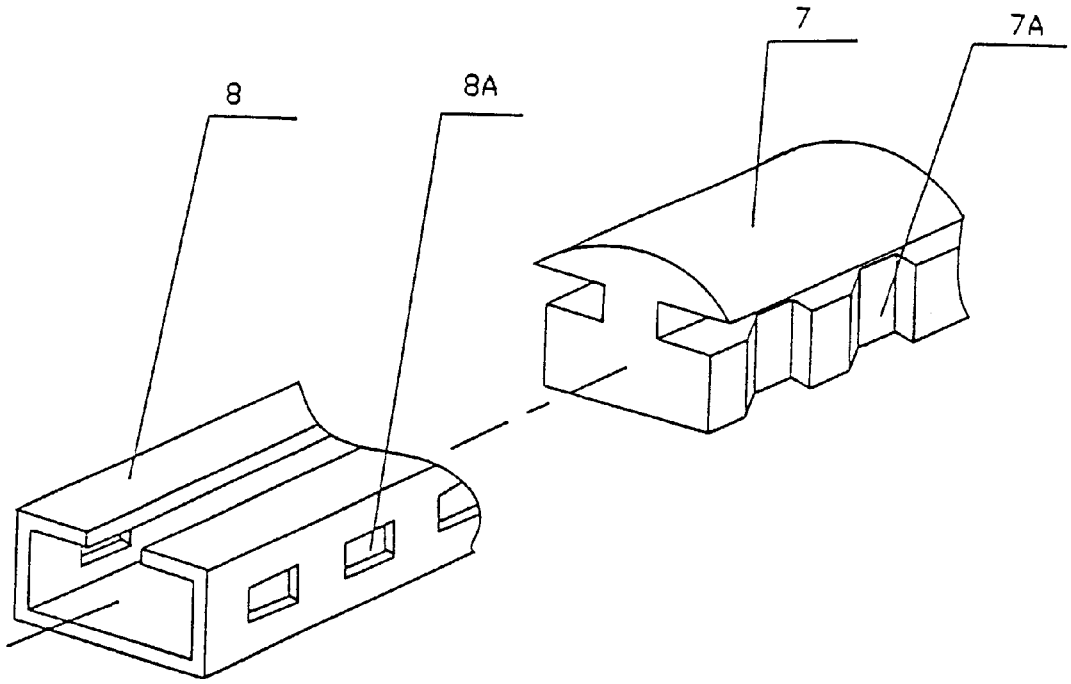
FIG. 5 is perspective view of fixed and moving elements in FIG. 1.

In order to have tidy appearance of the invention, as shown in FIG. 3, part of the section of said controlling rod 7 accommodates in the hollow outer layer oriented rack 8, the other part is sheathed on the outer layer oriented rack 8 through the opening of outer layer oriented rack 8. The corresponding part of outer layer oriented rack 8 can limit the controlling rod 7 to separate from outer oriented layer rack 8, and can slide axially along outer layer oriented rack 8 only. The outer surface of the top of controlling rod 7 is in arc shape, the arc shape surface and the arc shape surface of inner pipe 9 form integral appearance correspondingly with approximate cylindrical shape. In addition, in locking device controlling pedestal 5 fixed on the outer pipe 1 is arranged and on its outside sleeve 6 is arranged. One end of the sleeve 6 sheaths on the outer pipe 1 firmly, the other end sheaths on the outer surface of both controlling rod 7 and inner pipe 9 slidingly. Therefore, controlling pedestal 5, elastic element 10, locking block 11 are all covered and sealed within the sleeve 6, can prevent outside dust and other rubbish from entering effectively to insure movement of controlling rod 7 freely and causing vacuum cleaner having tidy appearance.

In the embodiment, as shown in FIG. 3, locking element is locking block 11, one end of the locking block 11 is connected with an elastic element 10. The locking block 11 could be a pair of strip having rectangular section. And is arranged on two sides of outer layer oriented rack 8 shown pincer-like, thereby the stability of the structure is better as well as the condition subjected to force of pushing or pulling, thereby extending or contracting operation of telescopic pipe is more smooth. The locking block 11 can slide in the sliding groove of controlling pedestal 5 fixed on the outer pipe 1. When outer layer oriented groove 8A coincides with inner layer oriented 7A, under the effect of elastic element 10 locking block 11 can enter in the two grooves coincided, thereby outer pipe 1 and inner pipe 9 are locked. When outer layer oriented groove 8A staggers with inner layer oriented groove 7A, locking block 11 is pushed out of oriented groove by groove side wall of oriented groove, thereby outer pipe 1 and inner pipe 9 are in releasing condition, extending and contracting operation could be achieved.

Side walls of groove of both inner layer oriented groove and outer layer oriented groove are in sloped shape, locking block 11 can slide along sloping face of side wall of groove. When pulling controlling rod 7 to adjust the length of telescopic pipe, the sloping face could cause locking block 11 sliding out of oriented groove and leading it enters into next oriented groove, acts for steadily moving of controlling rod 7 and well hand-sense of operation.

As shown in FIG. 1, two ends of controlling rod 7 as moving element can be provided with limiting device. In the embodiment, limiting device is arranged on the front end of controlling rod 7 only, the limiting device comprises of retaining block 3 and sealing ring 2. Retaining block 3 is fixed on the inner pipe 9 and together with sealing ring 2 to limit maximum axial sliding displacement of controlling rod 7. In addition, one end of retaining block 3 connects with elastic element 4 and can adjust the position of elastic element 4 through retaining block 3, thereby adjusts extending and contracting displacement of the elastic element 4.

The action of the embodiment is achieved such that, when pulling or pushing operating device 12, elastic element 4 is tensed or pressed, controlling rod 7 slides a certain distance along inner pipe 9 axially, bringing inner layer oriented groove 7A to stagger with outer layer oriented groove 8A. The locking block 11 in the controlling pedestal 5 is pushed out of the oriented groove by sloped inner wall of both inner layer and outer layer oriented grooves, thereby causing inner pipe 9 and outer pipes 1 are in releasing condition. At this time, inner pipe 9 can axially slide very steadily and reliably, thereby adjust the displacement of telescopic pipe. When inner pipe 9 moves to a suitable length required by the user, releasing operating device 12, under the effect of elastic element 4 controlling rod 7 is recovered to original position and causing outer layer oriented groove 7A coincides with inner layer oriented groove 8A. Under the effect of elastic element 10 locking block 11 in the controlling pedestal 5 enters into inner and outer oriented grooves along sloped faces of grooves once again and locking its position. At this time, user can use it conveniently and reliably.

EMBODIMENT 2

Figure 6:
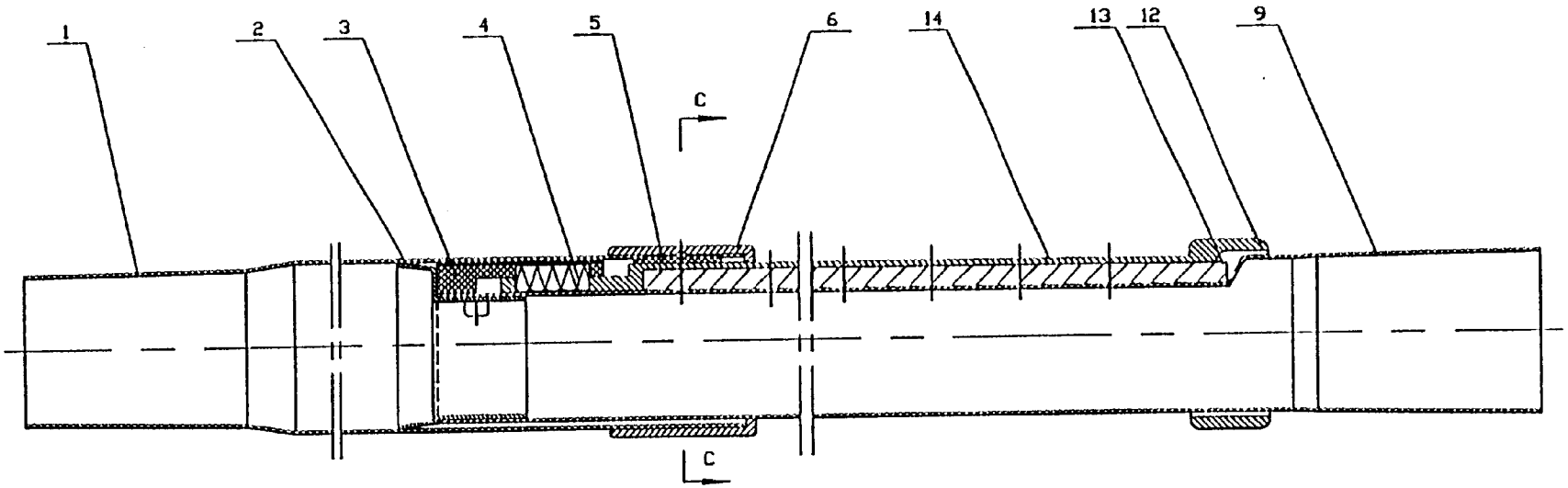
FIG. 6 is a structural sketch of the second embodiment of the invention.
Figure 7:
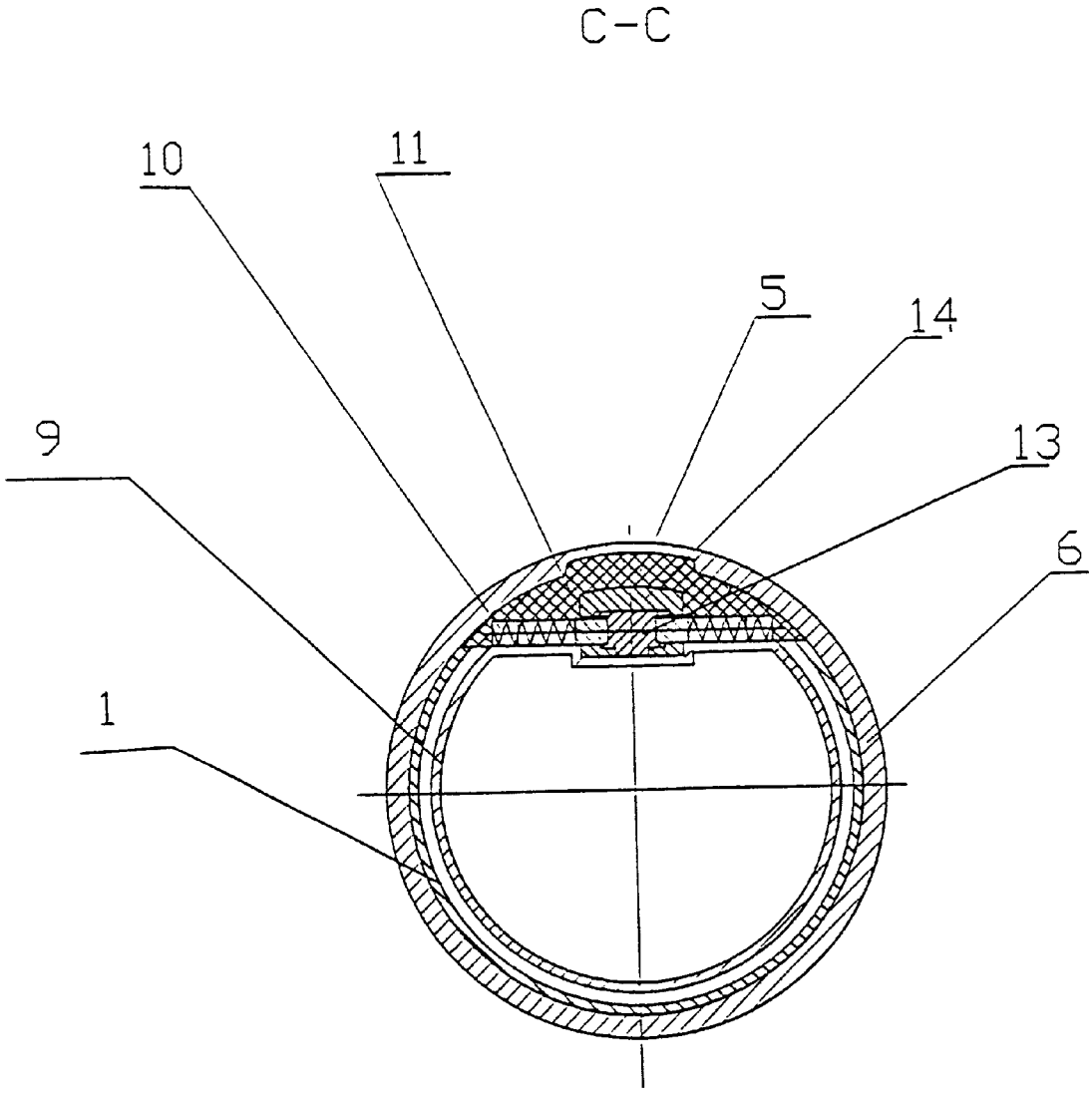
FIG. 7 is C—C sectional view of FIG. 6.
Figure 8:
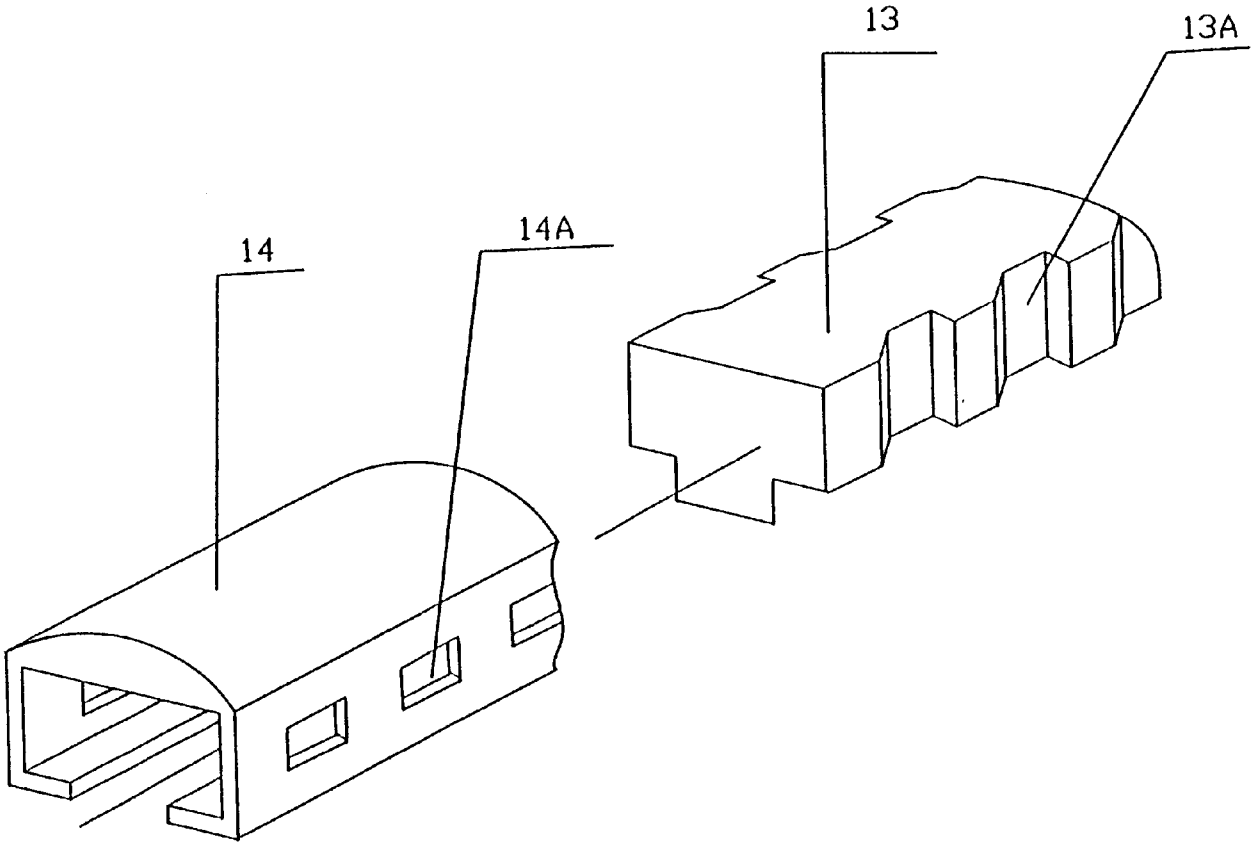
FIG. 8 is perspective view of fixed and moving elements in FIG. 6.

As shown in FIGS. 6–8, in the embodiment, said fixed element comprises of inner oriented rod 13 fixed on the inner pipe 9, moving element comprises of outer oriented rack 14 slid relative to inner pipe 9 axially. The inner oriented rod 13 is inlaid in one side of the outer surface of inner pipe 9 axially and fixed relatively to inner pipe 9, and is arranged protrudingly on outer surface of the inner pipe 9. An opening is arranged axially on outer oriented rack 14, causing outer oriented rack14 to form a hollow structure of open style, easy to arrange through for inner oriented rod 13. The open style outer oriented rack 14 in the embodiment reduces its processing difficulty greatly as well as easy to fit and assemble with inner oriented rod 13.

In the embodiment, as shown in FIG. 8, on both sides of the inner oriented rod 13 as fixed element provided symmetrically with outer layer oriented groove 13A arranged at intervals axially; on outer oriented rack 14 as moving element provided correspondingly with outer layer oriented groove 14A. The back end of the outer oriented rack 14 connects with an operating device 12, the operating device 12 sheaths on inner pipe 9 and can slide along inner pipe 9;

pushing or pulling operating device 12 can bring outer oriented rack 14 to move axially. When outer oriented rack 14 moves a certain distance axially, outer layer oriented groove 14A arranged on outer oriented rack 14 could be coincided or staggered with to the inner layer oriented groove 13A on inner oriented rod 13.

In the embodiment, when inner layer oriented groove 13A coincides with outer layer oriented groove 14A, said locking element is pressed into oriented grooves coincided by elastic element 10, thereby inner pipe 9 is locked relatively to outer pipe 1. After outer oriented rack 14 moves axially, inner layer oriented groove 13A staggers with outer layer oriented groove 14A. The locking element is pushed out by groove wall of inner layer oriented groove 13A, thereby to release the locking condition of inner pipe relative to outer pipe. At this time, telescopic pipe could be adjusted arbitrarily to the requiring length.

In the embodiment, the front end of outer oriented rack 14 is provided with an elastic element 4, one end of the elastic element 4 is connected with one end of inner pipe 9 firmly, the other end is fixed on one end of outer oriented rack 14. When outer oriented rack 14 is pushed or pulled, the elastic element 4 is in the condition subjected tension or press. When telescopic pipe is adjusted to the suitable length, after releasing the operating device 12, elastic element 4 can cause outer oriented rack 14 to bring outer layer oriented groove 14A recovering. Inner layer oriented groove coincides with outer layer oriented groove, locking element is pressed into the oriented grooves coincided by elastic element 10, thereby inner pipe 9 is locked relatively to the outer pipe 1. At this time, user can do cleaning operation conveniently and reliably, and do not worry about telescopic pipe sliding in the middle way and affects the operation.

In order to cause the invention to have tidy appearance, in the invention, as shown in FIG. 8, the section of said outer oriented rack 14 is in non-closed hollow shape, and the inner oriented rod 13 can be arranged through it. The lower end of inner oriented rod 13 is provided with a projection using for orientation, the lower end of orienting projection can be inlaid into side-groove of inner pipe 9, to cause inner oriented rod 13 to be fixed relatively to inner pipe 9. The opening of the outer oriented rack 14 could clutch two sides of the projection of inner oriented rod 13 slidingly, thereby outer oriented rack 14 could be slide steadily reliably and along inner oriented rod 13 relatively to the inner pipe 9 axially. The outer surface of upper part of the outer oriented rack 14 is in arc shape, the arc surface corresponding with the arc surface of the inner pipe 9 forms integral appearance in approximate cylindrical shape. In addition, controlling pedestal 5 fixed on the outer pipe 1 is arranged in locking device, sleeve 6 is arranged on its outside. One end of the sleeve 6 sheaths on the outer pipe 1 firmly, the other end sheaths slidingly on the outer surface of both outer oriented rack 14 and inner pipe 9. Therefore, controlling pedestal 5, elastic element 10, locking block 11 are all sheathed and sealed in the sleeve 6, could prevent outside dust and other rubbish from entering effectively, insure outer oriented rack 14 pushing and pulling freely, and cause vacuum cleaner to have tidy appearance.

In the embodiment, as shown in FIG. 7, locking element is locking block 11, one end of the locking block 11 is connected with an elastic element 10. The locking block 11 could be a pair of strip with rectangular section, and is arranged on two sides of outer oriented rack 14 showing pincer-like, to insure telescopic pipe extending and contracting steadily and reliably. The locking block 11 can slide in the sliding groove of controlling pedestal 5 fixed on outer pipe 1. When outer oriented groove 14A is coincided with inner oriented groove 13A, under the effect of elastic element 10, locking block 11 can enter into two grooves coincided, thereby outer pipe 1 and inner pipe 9 could be locked. When outer layer oriented groove 14A is staggered with inner layer oriented groove 13A, locking block 11 is pushed out of oriented groove by groove wall of the oriented groove, so as to cause outer pipe 1 and inner pipe 9 to be in releasing condition. Extending and contracting operation could be achieved.

Groove side walls of both inner layer oriented groove 13A and outer layer oriented groove 14A are all in sloped shape, locking block 11 can slide along sloped face of groove side wall. When pulling outer oriented rack 14 to adjust the displacement of telescopic pipe, the sloped face can cause locking block 11 to slide out of the oriented groove. And can lead it entering into next oriented groove, and acts for steadily moving of controlling rod 7 and well hand-sense for operation.

As shown in FIG. 6, two ends of outer oriented rack 14 as moving element could be provided with limiting device, in the embodiment, the front end of outer oriented rack 14 is provided with limiting device only. The limiting device comprises of retaining block 3 and sealing ring 2, retaining block 3 is fixed on the inner pipe 9, together with sealing ring 2 to limit maximum axial sliding displacement of controlling rod 7. In addition, one end of retaining block 3 is connected with elastic element 4. The position of elastic element 4 could be adjusted through retaining block 3, thereby extending and contracting displacement of elastic element 4 is adjusted. The action of the embodiment is achieved in that, when pushing or pulling operating device 12, elastic element 4 is tensed or pressed. Outer oriented rack 14 slides a certain distance along inner pipe 9 axially, bringing outer layer oriented groove 14A to stagger with inner layer oriented groove. Inner walls in sloped state of both inner and outer layer oriented grooves 13A, 14A pushing locking block 11 in the controlling pedestal 5 out of oriented grooves, thereby cause inner pipe 9 and outer pipe 1 to be in releasing condition. At this time, inner pipe 9 can slide axially and very steadily and reliably, so as to adjust the displacement of telescopic pipe. After inner pipe 9 slides to the suitable length requiring of user, releasing operating device 12, under the effect of the elastic element 4 outer oriented rack 14 will recover to the original position, cause inner layer oriented groove 13A to coincided with outer layer oriented groove 14A. Under the effect of elastic element 10 locking block 11 in controlling pedestal 5 enters into inner and outer layer oriented grooves along sloped face of groove again and locks its position. At this time, user can use vacuum cleaner conveniently and reliably.

EMBODIMENT 3

Figure 9:
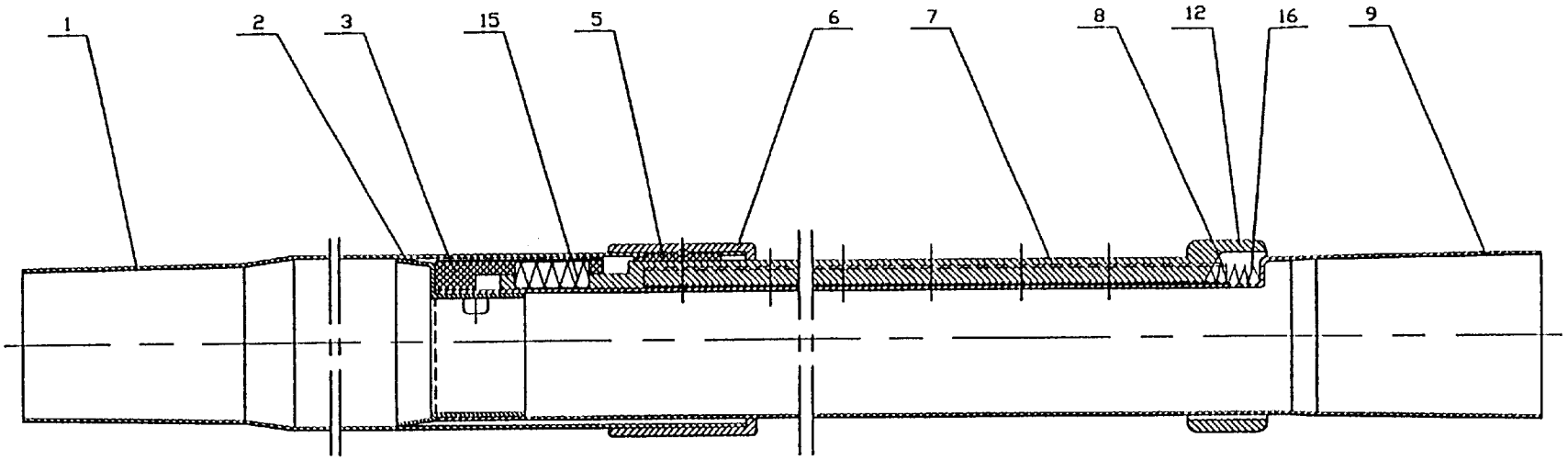
FIG. 9 is a structural sketch of the third embodiment of the invention.

As shown in FIG. 9, the structure and action principle of the embodiment is substantial the same as embodiment 1, no more to say here. The difference is in that, in the embodiment, on two ends of moving element elastic elements 15, 16 are provided with respectively. Elastic elements 15, 16 do not connect with both moving element and limiting device, only are arranged simply in the side groove of inner pipe 9. Such that, two ends of both elastic elements 15, 16 and moving element are not necessary to provided with any connecting device, the integral structure is simpler and easier to process and assemble. In the embodiment, when pulling operating device 12 to bring moving element to slide axially, elastic element 15 of one end is in free condition, elastic element 16 of the other end is pressed.

After moving element slides a certain distance along inner pipe 9 axially, bringing outer layer oriented groove 8A to stagger with inner layer oriented groove 7A. The locking block 11 in controlling pedestal 5 is pushed out of oriented grooves by sloped state inner walls of both inner and outer layer oriented groove 7A, 8A. Thereby causing inner pipe 9 and outer pipe 1 to be in releasing condition. When inner pipe 9 slides to the suitable length requiring by the user, releasing operating device 12, under the elasticity effect of the elastic element 16 moving element is recovered, causing inner layer oriented groove 7A to coincide with outer layer oriented groove 8A. Under the effect of elastic element 10, locking block 11 in controlling pedestal 5 enters into inner and outer layer oriented grooves again along sloped faces of grooves, its position is locked. Similarly, when pushing operating device 12 to bring moving element to slide axially, elastic element 16 of one end is in free condition, elastic element15 of the other end is pressed, after releasing operating device 12, under the effect of elastic element 15 moving element is recovered, thereby operating position is locked.

The embodiment can also be embodied to the structure of embodiment 2, except substituting outer oriented rack 14 in stead of moving element and substituting inner oriented rod 13 in stead of fixed element. The rest of the structure and working principle is substantial the same as state embodied to embodiment 1, no more to say here.

Above mentioned is preferable embodied method of the invention only, does not for limiting the invention. Both moving element and fixed element in the invention could be changed to other form.

What is claimed:

1. A telescopic dust collecting pipe for a vacuum cleaner comprising: an outer pipe and an inner pipe slidingly arranged in the outer pipe, said outer pipe being connected to the inner pipe by a locking device, said locking device comprising an oriented locking mechanism and a locking element, said oriented locking mechanism comprising an element relatively fixed to the inner pipe and a moving element axially movable relative to the fixed element, the locking device further comprising oriented grooves arranged axially at least on facing sides of said fixed element and moving element to form corresponding inner and outer layer oriented grooves, said moving element to move axially in such a way that the inner layer oriented groove either coincides with or staggers with said outer layer oriented groove; said locking element being pressed against said oriented grooves from a side face by an elastic element when said inner layer oriented groove coincides with said outer layer oriented groove, whereby said locking element can enter into the oriented grooves to lock the inner pipe and the outer pipe relatively, and when the moving element moves axially to stagger said inner layer oriented groove with said outer layer oriented groove, said locking element is pushed out of the inner layer oriented groove by a groove wall, whereby the inner pipe and the outer pipe are released from one another.

2. A telescopic dust collecting pipe for a vacuum cleaner according to claim 1, wherein said oriented grooves are provided along two side faces of each of said fixed and moving elements, said locking element being pressed against said on oriented groves from said two side faces by said elastic element in a pincer-like state.

3. A telescopic dust collecting pipe for a vacuum cleaner according to claim 1, wherein said fixed element is hollow, said outer layer oriented groove being arranged on the fixed element, said moving element being slidingly arranged in the hollow fixed element, said inner layer oriented groove being arranged on the moving element, said inner layer oriented groove being sloped.

4. A telescopic dust collecting pipe collecting pipe for a vacuum cleaner according to claim 1, wherein said moving element is hollow, said outer layer oriented groove being arranged on the moving element, said fixed element being arranged in the hollow of the moving element, said inner layer oriented groove being arranged on the fixed element, said inner layer oriented groove being sloped.

5. A telescopic dust collecting pipe for a vacuum cleaner according to claim 1, wherein said fixed element is a hollow outer layer oriented rack, said hollow outer layer oriented rack protruding from the outer wall of said inner pipe, said moving element being arranged in said hollow outer layer oriented rack.

6. A telescopic dust collecting pipe for a vacuum cleaner according to claim 3, wherein said hollow fixed element is a hollow outer layer oriented rack, said hollow outer layer oriented rack protruding on the outer wall of said inner pipe, said moving element being arranged in said hollow outer layer oriented rack.

7. A telescopic dust collecting pipe for a vacuum cleaner according to claim 3, wherein an axial opening is arranged along an upper end of said hollow outer layer oriented rack and said moving element comprises a controlling rod slidingly arranged in said outer layer oriented rack, a flange being arranged on an upper end of said controlling rod for covering the axial opening of the upper end of said hollow outer layer oriented rack.

8. A telescopic dust collecting pipe for a vacuum cleaner according to claim 6, wherein a lower end of said hollow outer layer oriented rack is adapted to be laid within said outer wall of said inner pipe.

9. A telescopic dust collecting pipe for a vacuum cleaner according to claim 1, wherein said locking element is a locking block or roller.

10. A telescopic dust collecting pipe for a vacuum cleaner according to claim 1, wherein one end of said moving element is firmly connected to an operating device, said operating device being slidingly sheathed outside of the inner pipe.

11. A telescopic dust collecting pipe for a vacuum cleaner according to claim 1, wherein at least one end of said moving element is provided with an elastic axial recovering element.

12. A telescopic dust collecting pipe for a vacuum cleaner according to claim 11, wherein said elastic axial recovering element is provided on one end of said moving element, one end of said elastic axial recovery being fixed to one end of said inner pipe and the other end being fixed to said moving element.

13. A telescopic dust collecting pipe for a vacuum cleaner according to claim 1, wherein on two ends of said moving element an axial limit device is provided to limit maximum stroke of said moving element.

14. A telescopic dust collecting pipe for a vacuum cleaner according to claim 1, wherein said locking element is laid in a controlling pedestal, said controlling pedestal being slidingly arranged along said outer wall of said inner pipe.

15. A telescopic dust collecting pipe for a vacuum cleaner comprising: an outer pipe and an inner pipe slidingly arranged in the outer pipe, said outer pipe being connected to the inner pipe by a locking device, said locking device comprising an oriented locking mechanism and a locking element, said oriented locking mechanism comprising an element relatively fixed to the inner pipe and a moving element axially movable relative to the fixed element and the outer pipe, the locking device further comprising oriented grooves arranged axially at least on facing sides of said fixed element and moving element to form corresponding inner and outer layer oriented grooves, said moving element to move axially in such a way that the inner layer oriented groove either coincides with or staggers with said outer layer oriented groove; said locking element being pressed against said oriented grooves from a side face by an elastic element when said inner layer oriented groove coincides with said outer layer oriented groove, whereby said locking element can enter into the oriented grooves to lock the inner pipe and the outer pipe relatively, and when the moving element moves axially to stagger said inner layer oriented groove with said outer layer oriented groove, said locking element is pushed out of the inner layer oriented groove by a groove wall, whereby the inner pipe and the outer pipe are released from one another.

* * * * *